US005445085A

United States Patent [19]

Westerburgen

[11] Patent Number: 5,445,085

[45] Date of Patent: Aug. 29, 1995

[54] FOLDING TABLE

[75] Inventor: Josephus P. M. Westerburgen, Heythuysen, Netherlands

[73] Assignee: Lawn Comfort S.A., Ans-Alleur, Belgium

[21] Appl. No.: 112,068

[22] Filed: Aug. 26, 1993

[30] Foreign Application Priority Data

Aug. 27, 1992 [NL] Netherlands ..... 9201509

[51] Int. Cl.[6] ..... A47B 3/00

[52] U.S. Cl. ..... 108/115; 108/167; 108/128

[58] Field of Search ..... 108/115, 127, 128, 132, 108/130, 64, 124, 167

[56] References Cited

U.S. PATENT DOCUMENTS

| | | | |
|---|---|---|---|
| 2,576,287 | 11/1951 | English | 108/115 X |
| 2,723,171 | 11/1955 | Carder | 108/64 |
| 2,791,477 | 5/1957 | Wesbecher | 108/124 |
| 2,836,475 | 5/1958 | Sapp | 108/64 |
| 2,887,348 | 5/1959 | Sadonsky | 108/124 |
| 3,188,158 | 6/1965 | Sanchez | 108/124 X |
| 5,205,223 | 4/1993 | Ball et al. | 108/115 X |
| 5,325,793 | 7/1994 | Martin | 108/115 X |

FOREIGN PATENT DOCUMENTS

| | | | |
|---|---|---|---|
| 1116697 | 2/1956 | France . | |
| 26155 | 9/1883 | Germany . | |
| 903956 | 8/1962 | United Kingdom . | |
| 1600684 | 10/1990 | U.S.S.R. | 108/115 |

*Primary Examiner*—Jose V. Chen

*Attorney, Agent, or Firm*—Cushman Darby & Cushman

[57] ABSTRACT

Folding table consisting of a tabletop and support, which tabletop is composed of two tabletop parts that are connected to one another in a manner that they can pivot between two extreme positions, the tabletop parts lying in one plane and constituting the tabletop in the first extreme position and the tabletop parts positioned parallel to one another, their bottom sides facing one another, in the second extreme position, the support consisting of two leg structures, each leg structure connected to a tabletop part in a manner that it can pivot around an axis parallel to the tabletop, and capable of assuming a normal position perpendicular to the plane of the tabletop in the first extreme position of the tabletop parts, and the leg structures positioned between the tabletop parts in the second extreme position of these parts, each leg structure comprising two leg parts which are connected to one another via a hinge whose axis of rotation in the normal position of the leg structure is perpendicular to the plane of the tabletop, each leg part capable of moving between two extreme positions, a first extreme position in which the leg parts and the appurtenant hinge are in one plane, and a second extreme position in which the leg parts, viewed in the direction perpendicular to the plane of the tabletop, form an angle, the ends of the leg parts furthest removed from the hinge pin further removed from the centre of the tabletop than in the first position.

10 Claims, 5 Drawing Sheets

FOLDING TABLE

The invention relates to a folding table consisting of a tabletop and a support, which tabletop is composed of two tabletop parts that are connected to one another in such a manner that they can pivot between two extreme positions, the tabletop parts lying in one plane and constituting the tabletop in the first extreme position and the tabletop parts being positioned parallel to one another, their bottom sides facing one another, in the second extreme position, the support consisting of two leg structures, each leg structure being connected to a tabletop part in such a manner that it can pivot around an axis parallel to the tabletop, and being capable of assuming a normal position perpendicular to the plane of the tabletop in the first extreme position of the tabletop parts, and the leg structures being positioned between the tabletop parts in the second extreme position of these parts.

Such a table is known from DE-A-3,943,398, which describes a table with which, in the first extreme position, the legs of the leg structure are situated as far as possible from the centre of the tabletop. This guarantees optimum stability of the table in this position. In order to reduce the space occupied in the second extreme position of the tabletop parts, the leg structures are mounted hinged and movable along the tabletop, so that in this position the leg structures lie practically close to the edges of the tabletop parts touching one another.

A folding table of such a design requires separate guiding against the bottom side of the tabletop, which is either a source of instability of the table or adversely affects the aesthetic appearance and the functionality of the table. Moreover it often implies an impediment in the nature of the leg structure.

The aim of the invention is to provide a table of the aforementioned kind which does not present the aforementioned drawbacks.

This aim is achieved according to the invention because each leg structure consists of two leg parts which are connected to one another via a hinge whose axis of rotation in the normal position of the leg structure is perpendicular to the plane of the tabletop, each leg part being capable of moving between two extreme positions, a first extreme position in which the leg parts and the appurtenant hinge are in one plane, and a second extreme position in which the leg parts, viewed in the direction perpendicular to the plane of the tabletop, form an angle, the ends of the leg parts furthest removed from the hinge pin being further removed from the centre of the tabletop than in the first position.

Figure 1:
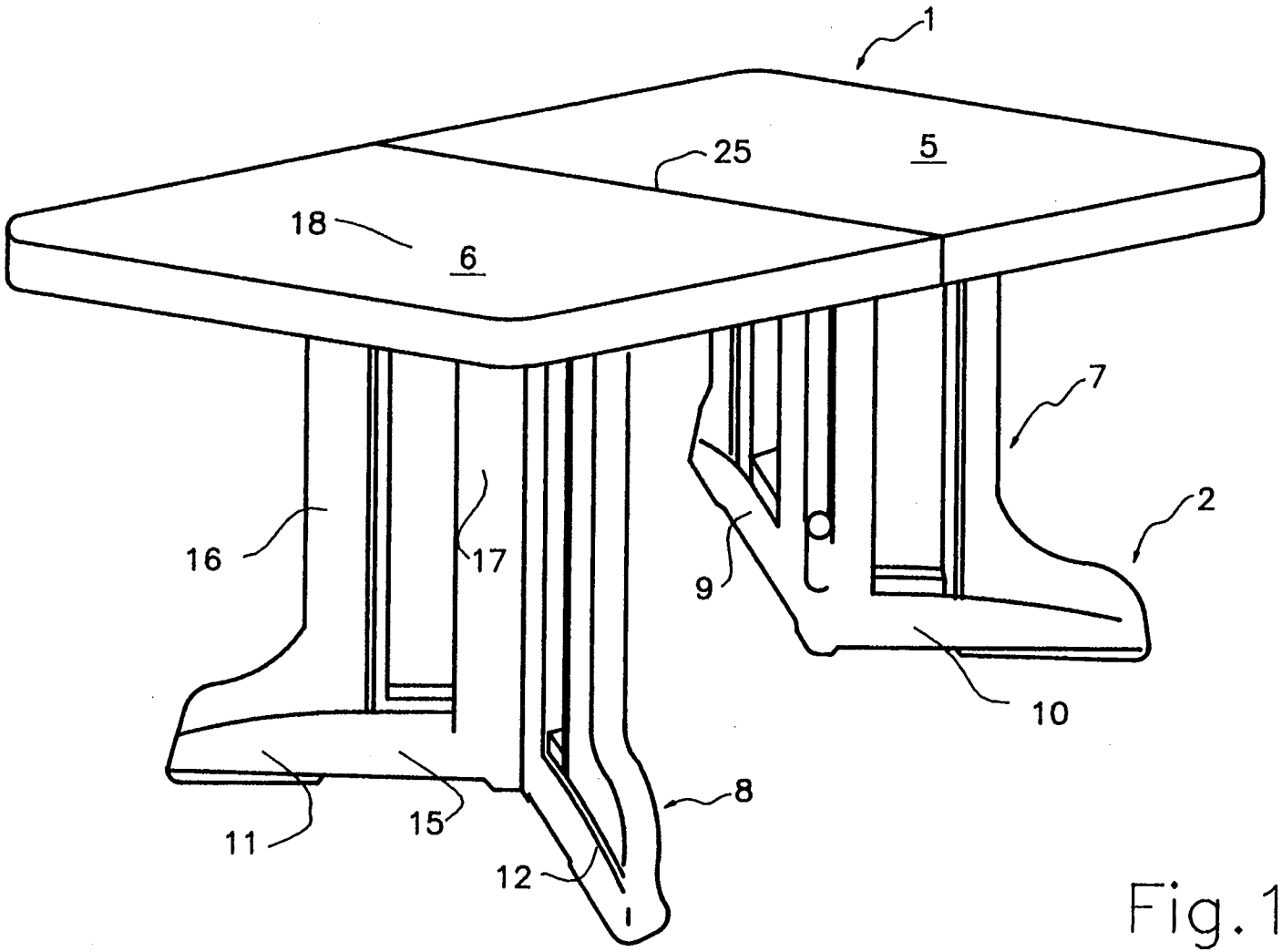
Figure 2:
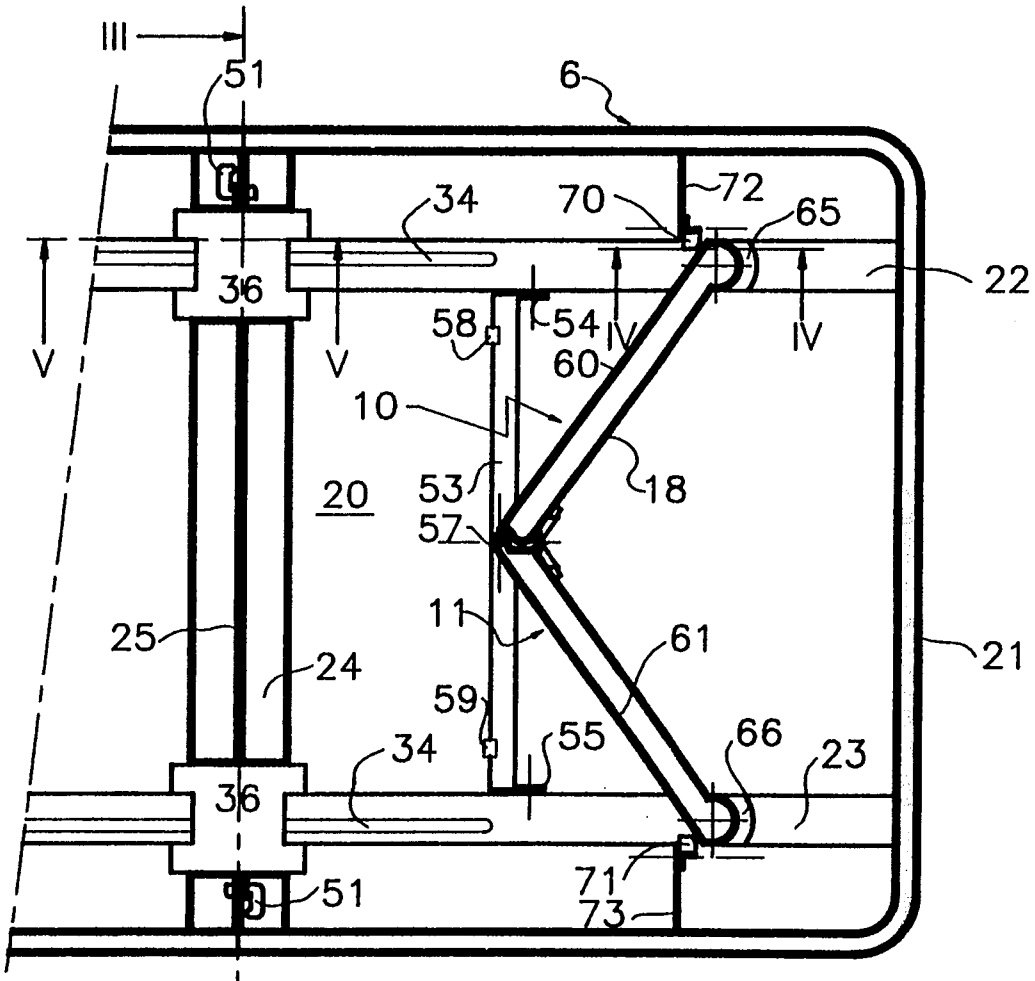
Figure 3:
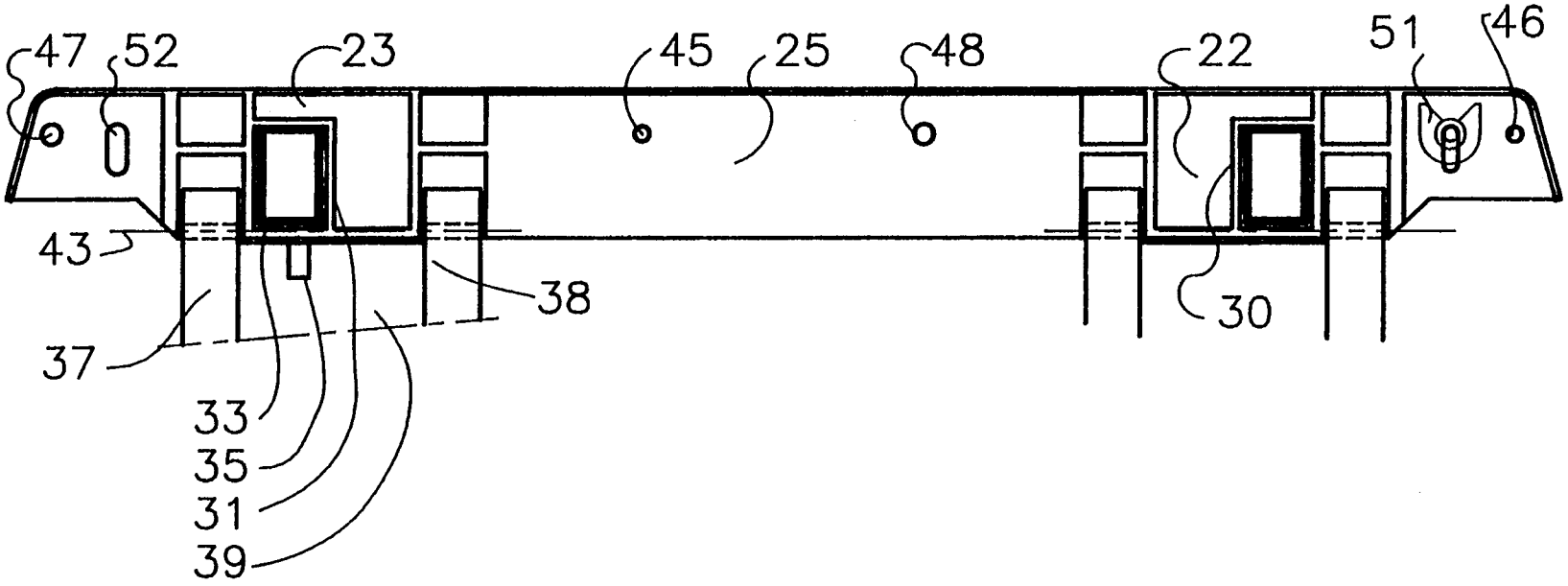
Figure 4:
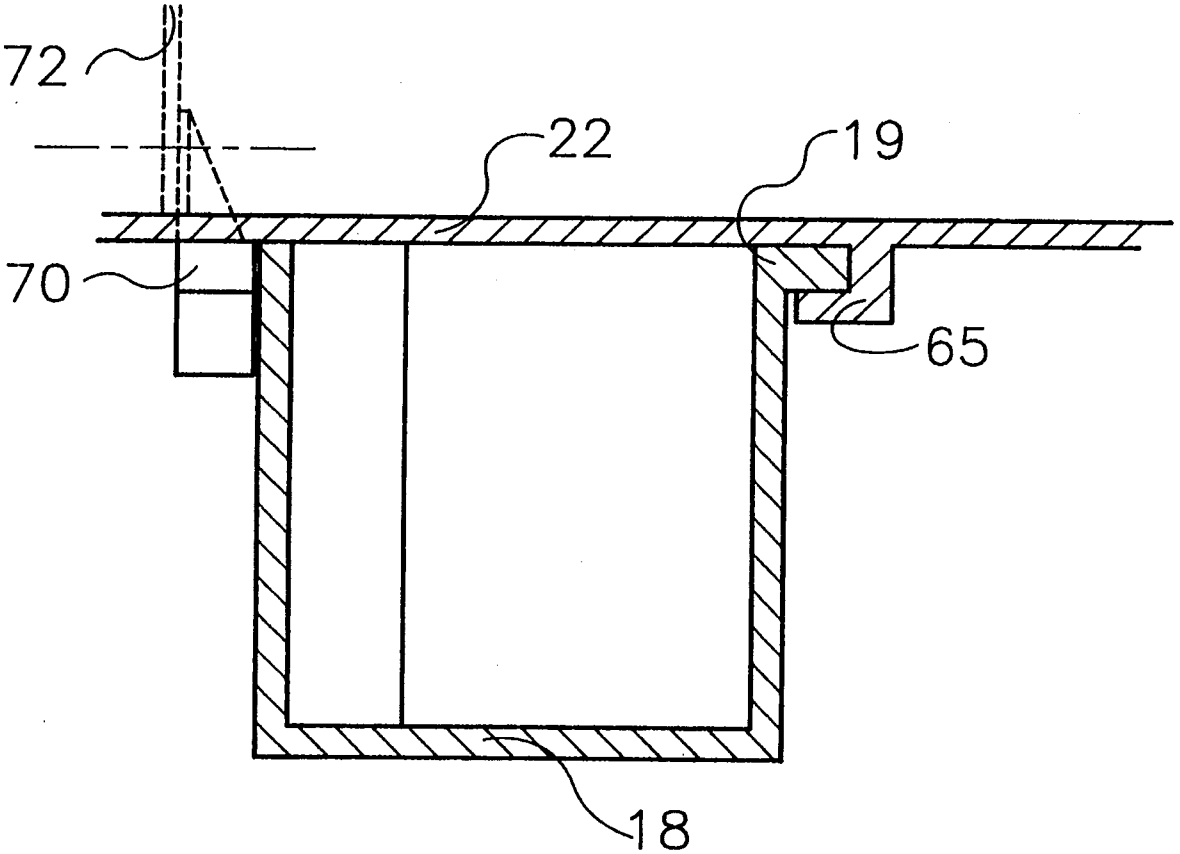
Figure 5:
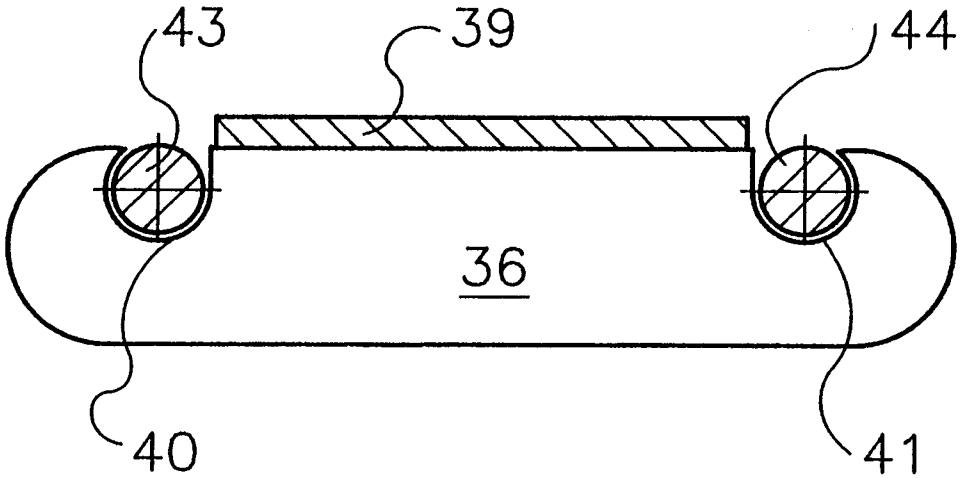

Other characteristics and advantages will become clear from the following description, in which reference is made to the appended drawings, in which:

FIG. 1 is a schematic perspective drawing of a folding table according to the invention, FIG. 2 is a partly cross-sectional view of part of the bottom side of the folding table according to FIG. 1, FIG. 3 is a view of the folding table along line III—III in FIG. 2, only in folded condition, FIG. 4 is a cross section, on a larger scale, along line IV—IV in FIG. 2 and FIG. 5 is a cross section, on a larger scale along line V—V in FIG. 2.

As illustrated in FIG. 1, the folding table according to the invention consists of a tabletop (1) and a support (2). The tabletop (1) consists of two tabletop halves (5 and 6) which are in principle identical to one another, as will be described in further detail below. The support (2) consists of two leg structures (7 and 8), each of which leg structures (7 and 8) in turn in principle consists of two leg parts (9 and 10 and 11 and 12, respectively). In principle the leg structures (7 and 8) are the same and the leg parts are substantially the same. The leg parts are essentially functional parts but, in connection with the foldability of the table, special specific design requirements may be imposed on them. Each leg part essentially consists of a first carrier (15) which is connected, by means of two vertical supports (16 and 17), to a second carrier (18; not shown) parallel to the first carrier, but lying against the bottom side of the tabletop, so that the tabletop rests on the ground via carrier 18, supports 16 and 17 and carrier 15.

As shown in FIG. 2, each tabletop part comprises a substantially rectangular, plate-shaped element (20) which constitutes the tabletop proper. Although in the further description reference will be made to a rectangular plate-shaped element, it will be clear that any other shape may be used. In connection with the sturdiness of the plate-shaped element (20), said element has a rim (21) perpendicular to it along three sides, which rim in fact has a section shaped like an inverted U. In addition, two substantially rectangular tubes (22 and 23) are moulded under the plate-shaped element (20), which tubes are integral with the plate-shaped element (20). At the bottom of the fourth side (25) of the plate-shaped element (20) there is also a reinforcing profile (24), which in fact has a section shaped like an inverted U, whose web plate is integral with the plate-shaped element (20). This fourth side (25) is the side with which one of the two tabletop parts adjoins the other tabletop part when the table is folded out.

In each of the rectangular tubes (22 and 23) a second tubular part (30 and 31, respectively) has been moulded. When the tabletop parts are positioned with their sides 25 facing one another, the tubular parts (30 and 31) in one of the two tabletop parts lie in line with the tubular parts (31 and 30, respectively) of the other tabletop part. When a bar is incorporated, in a manner allowing movement, in each of the two pairs of tubular parts lying in line with one another, it can be moved so that it projects partly into both the tubular part (30 or 31) of one of the tabletop parts and into the tubular part (31 or 30, respectively) of the other tabletop part. In FIG. 3 a bar is shown in tubular part 31, the tubular part of which (32) fits into 31 in its entirety, which bar has a boss (35) which projects through a groove-shaped recess (34) in tube 23, so that the bar (33) can be moved in tubular part 31 via this boss (35). In this way the tabletop can be better supported at the joint between the two tabletop parts when the table is folded out, while the bars (33) can be incorporated in their entirety in tubular parts 30 and 31, respectively, when the table is folded up.

Two tabletop parts are hinged to one another with sides 25 facing one another by means of a bridge (36) as shown in FIG. 5. Each bridge consists of two link parts parallel to one another (37 and 38), which are connected to one another by means of a supporting plate (39). In each link part (37 and 38) there are two recesses (40 and 41, respectively) which are suitable for accommodating shaft ends 43 and 44, moulded on the sides of tubes 22 and 23 and reinforcing profile 24, so that said shaft ends can rotate. In this way each bridge (36) is connected to each of the tabletop parts (5 and 6), in a manner allowing pivoting, via two recesses, one in each link part, and two shaft ends, as a result of which one of the two tabletop parts is connected to the other tabletop part, in a manner allowing pivoting, via a double hinge. This makes it possible to pivot the tabletop parts to a position in which the parts are parallel to one another and, moreover, a certain amount of space remains between the two tabletop parts. This position is represented in FIG. 3.

A number of provisions have been made against and in side 25 of each of the two tabletop parts (5 and 6), which provisions are to ensure that the two tabletop parts adjoin each other well and can also be locked relative to one another. As shown in FIG. 3, two pins (45 and 46) extending in a direction parallel to the tabletop are provided. In addition, two holes (47 and 48) have been made. The design is such that the pins (45 and 46) of one of the two tabletop parts fit into the holes (47 and 48) of another tabletop part when the tabletop parts are positioned so as to adjoin one another. In principle the pins (45 and 46) and the corresponding holes (47 and 48) may have any desired cross section. In addition, a locking device (51) is provided, which can cooperate with a corresponding opening (52). In the illustrated embodiment the locking device consists of a pin that can rotate in side 25, the end of said pin facing the other tabletop part having a thicker part, so that the pin has an oval cross section at that point and can be accommodated by a corresponding oval opening (51) in one position. The other end of the pin also has a thicker part, which is rather shaped like a handle. When the pin (51) is in the correct position, the two tabletop parts can be positioned against one another, after which, by a twisting of the pin (51) in the opening (52), the two tabletop parts can be locked together. Two such locking pins (51) are shown in FIG. 2. It will however be clear that other locking options are also suitable for fixing the two tabletop parts relative to one another. In this way two tabletop parts can be connected to one another so that they cannot move relative to one another, neither in a direction parallel to the tabletop, nor in a direction perpendicular to the tabletop.

A beam (53) is provided between the two rectangular tubes (22 and 23), whose ends are fitted with flanges (54 and 55) on which pins are mounted, which are accommodated by openings in the rectangular tubes (22 and 3), in which they can rotate, as schematically illustrated in FIG. 2. In this way the beam (53) is incorporated between the tubes (22 and 23) in such a manner that it can rotate around an axis parallel to side 25 and hence also relative to the tabletop part (6).

On the beam (53) A shaft (57) is mounted which in the position illustrated in FIG. 2 is perpendicular to the tabletop (1). Two leg parts (9 and 10) are mounted so that they can pivot around this shaft (57). These leg parts can also be pivoted between two extreme positions. In the first extreme position (not shown) the leg parts lie in line with one another, beneath the beam (53). In order to be able to fix the leg parts in this position, the beam (53) is provided with two lips (58 and 59) which each consist of an L-shaped profile whose free end has a thicker part. Each lip (58 and 59) can cooperate with a recess (60 and 61, respectively) in carrier 18 of the leg part, said recesses (60 and 61) having such dimensions that the lips are tightly incorporated in them via the thicker parts at their free ends. Because of the elasticity of the material of which the lips are made, it is possible, by exerting some pressure, to release the leg parts from the beam (53) and to pivot them to the second extreme position illustrated in FIG. 2. The lips (58 and 59) also ensure that the leg parts cannot be pivoted further towards the centre of the table.

When the leg parts (10 and 11) are in the first extreme position they can be pivoted, together with the beam (53), in a direction away from the centre, around the axis of rotation of the beam (53), and can be positioned so that the leg parts are parallel or practically parallel to the tabletop. When the tabletop halves (5 and 6) are then also folded towards one another around the bridges, the table is folded up in such a manner that the leg structures of the two table halves adjoin one another and can be used as such to support the table, the two tabletop halves being positioned vertically on either side of the leg structures. In this way the table can be easily transported and effectively stored. 'Effectively' is here understood to mean that a small amount of space is occupied and that the support is optimum without causing damage to parts of the table because the table rests on the leg parts in this position too.

In the second extreme position of the leg parts (10 and 11) the leg parts form an angle as shown in FIG. 2. With respect to the first extreme position, the leg parts are then pivoted in a direction away from the centre of the table. In order to define the second extreme position and also to be able to fix the leg parts in this position too, a rim (65 and 66) is moulded onto each tube (22 and 23, respectively). As shown in FIG. 4, the rims (65 and 66) have L-shaped cross sections and have a shape that is adjusted to the part of carrier 18 of the leg sections (10 and 11). The part of carrier 18 that comes into contact with the rim is provided with a projecting rim part (19), which can be slid under rims 65 and 66. In the illustrated embodiment rims 65 and 66 are circular and the corresponding part of the carrier is also circular. In this manner it is ensured that in the second extreme position of the leg parts (10 and 11) the latter cannot be pivoted around shaft 57 and [that the latter] form a whole with the tabletop.

In order to avoid the possibility of the leg parts (10 and 11) being pivoted relative to the shaft (57) in their second extreme position, a catch (70 and 71) is provided for each leg part (10 and 11, respectively), each catch (70 and 71) being rotatable in a flange (72 and 73, respectively) provided between the tube (22 and 23, respectively) and the raised rim (21). In the position illustrated in FIGS. 2 and 4 catch 70 is clamped against carrier 18 of leg part 10 so that the latter cannot pivot around the shaft (57). When the catch is turned far enough, leg part 10 is released and can be pivoted around the shaft (57) towards the centre.

Preferably the various parts of the table are made of plastic, which plastic has such an elasticity that self-clamping actions occur. In particular this applies to the operation of the locking device (51), the operation of the lips (58 and 59) and the operation of the catches (70 and 71).

It will be clear that the invention is not limited to the embodiment described and illustrated but that numerous alterations can be applied within the framework of the claims.

I claim:

1. Folding table comprising:

a tabletop and a support, said tabletop being composed of two tabletop parts that are connected to one another in such a manner that they can pivot between first and second extreme positions, the tabletop parts lying in one plane and constituting the tabletop in the first extreme position and the tabletop parts being positioned parallel to one another with their bottom sides facing one another, in the second extreme position, said support consisting of two leg structures, each leg structure being connected to a tabletop part in such a manner that it can pivot around an axis parallel to the tabletop, and each leg structure being capable of assuming a normal position perpendicular to the plane of the tabletop in the first extreme position of the tabletop parts, and the leg structures being positioned between the tabletop parts in the second extreme position of the tabletop parts, wherein each leg structure comprises two leg parts which are connected to one another via a hinge whose axis of rotation in a normal position of the leg structure is perpendicular to the plane of the tabletop, each leg part being capable of moving between a first extreme leg position in which the leg parts and the hinge are in one plane, and a second extreme leg position in which the leg parts, view in the direction perpendicular to the plane of the tabletop, form an angle and in this second extreme leg position support a tabletop part.

2. The table according to claim 1, wherein each tabletop part has a rim which in the first extreme position adjoins a complementary rim of the other tabletop part, each rim being provided with at least one axis parallel to the tabletop part, each axis of a rim being connected by a bridge to an opposite axis of the complementary rim, the bridge being provided with recesses to pivotably receive the at least one axis, each tabletop part being pivotable around the at least one axis of the rim of said tabletop part.

3. The table according to claim 2, wherein each of the rims of the tabletop parts rests on the bridge in the first extreme position of the tabletop parts.

4. The table according to claim 3, wherein at least two bridges are provided.

5. The table according to claim 1 wherein a leg part can be locked in the second extreme leg position against movement of the leg structure of which the leg part forms part thereof.

6. The table according to claim 1 wherein each leg part can be locked, in the second extreme leg position, against movement around the axis perpendicular to the plane of the tabletop part.

7. The table according to claim 1, wherein the rims of the tabletop parts which adjoin one another in the first extreme position are provided with a number of bosses and recesses, respectively, which interlock in the first extreme position of the tabletop parts.

8. The table according to claim 7, wherein at least one boss is shaped like a pin which can rotate around an axis parallel to the tabletop part, a free end of said pin having a boss, and wherein the corresponding recess in the other tabletop part has a shape to accommodate the pin in one position and that in other positions the boss on the pin fixes the tabletop parts relative to one another.

9. The table according claims 1 wherein two tabletop parts placed against one another can be locked relative to one another.

10. The table according to claim 1, wherein each tabletop part on its underside is provided with at least one rectangular tubular part, each tubular part under a tabletop part in the first extreme position lying in line with a tubular part under the other tabletop part and that a reinforcing bar is incorporated in one of the tubular parts, in a manner allowing movement in said tubular part and in the tubular part lying in line with it.

* * * * *